United States Patent [19]

Cadars

[11] Patent Number: 4,492,267

[45] Date of Patent: Jan. 8, 1985

[54] WATER BOX AND EXPANSION CHAMBER DEVICE FOR A HEAT EXCHANGER

[75] Inventor: Patrick Cadars, Montigny, France

[73] Assignee: Valeo, Paris, France

[21] Appl. No.: 344,757

[22] Filed: Feb. 1, 1982

[30] Foreign Application Priority Data

Feb. 12, 1981 [FR] France ..... 81 02764

[51] Int. Cl.[3] ..... F01P 11/02

[52] U.S. Cl. ..... 165/104.32; 123/41.54; 165/173; 165/11 R; 165/DIG. 8

[58] Field of Search ..... 165/104.32, 176, 175, 165/173, DIG. 8; 123/41.51, 41.54

[56] References Cited

U.S. PATENT DOCUMENTS 4,116,268 9/1978 Kruger ..... 123/41.54
4,190,101 2/1980 Hartman ..... 165/176
4,231,424 11/1980 Moranne ..... 165/104.32

FOREIGN PATENT DOCUMENTS 2013804 10/1971 Fed. Rep. of Germany ..... 165/175
2458379 1/1981 France .

*Primary Examiner*—Albert W. Davis, Jr.
*Attorney, Agent, or Firm*—Dennison, Meserole, Pollack & Scheiner

[57] ABSTRACT

In a heat exchanger or radiator for an engine-cooling circuit, a device forming a water box and an expansion chamber which are made in a single piece by moulding, but which are formed as separate containers that do not share a common partition, although they may be held together by a thin strip of material (27). The containers are of cylindrical or semi-cylindrical shape for strength.

13 Claims, 8 Drawing Figures

WATER BOX AND EXPANSION CHAMBER DEVICE FOR A HEAT EXCHANGER

The invention relates to a water box and expansion chamber device for a heat exchanger such as a radiator in the cooling circuit of a vehicle engine.

BACKGROUND OF THE INVENTION

Such a device is already known and generally comprises a single container in which the expansion chamber is separated from the water box of the radiator by a partition wall inside the container. This arrangement suffers from the drawback of not standing up very well to deformation under the effect of internal pressure variations, and the single container sometimes even cracks or breaks.

Preferred embodiments of the present invention provide a stronger water box and expansive chamber device which does not suffer from this drawback.

SUMMARY OF THE INVENTION

The present invention provides a water box and expansion chamber device for a heat exchanger, said device comprising at least a part of the wall of the expansion chamber and at least part of the wall of the water box, wherein the expansion chamber and the water box are each constituted by respective containers or tanks which are external to each other, and wherein at least said parts of the walls constituting the device are made in a single piece and are optimally shaped for strength against deformation caused by changes in pressure inside said containers, for example being of substantially circular or semi-circular cross section.

The point of the optimal shape is to make more efficient use of the material from which the device is made, thereby making it possible to reduce its weight and cost.

It has also been observed, in a most unexpected manner, that a device in accordance with the invention and made of plastics material has a much longer service life than a conventional device constituted from a single container in which the partition wall separating the expansion chamber from the water box is made of plastics material. It appears that hydrolysis occurs where the plastic is immersed in cooling fluid, and if it is immersed on both sides (as in the case of the partition wall) cracks form through the plastic more quickly than when only one side is immersed.

A device in accordance with the present invention does not include any portion of its walls that are immersed on both sides in cooling fluid.

Preferably both containers are connected by a thin strip of material coming from a single piece moulding operation. This increases the rigidity of the device and makes it stand up better to vibration.

Advantageously, a filler inlet to the expansion chamber is provided on a separate plate that otherwise closes one end of the expansion chamber. The filler inlet it itself closed with some form of suitable stopper. The advantage lies in the fact that the expansion chamber may have a desired cross-sectional size which does not depend on the filler inlet size.

The invention also provides a heat exchanger including a device as defined above.

BRIEF DESCRIPTION OF THE DRAWINGS

Embodiments of the invention are described by way of example with reference to the accompanying drawings, in which.

MORE DETAILED DESCRIPTION

Figure 1:
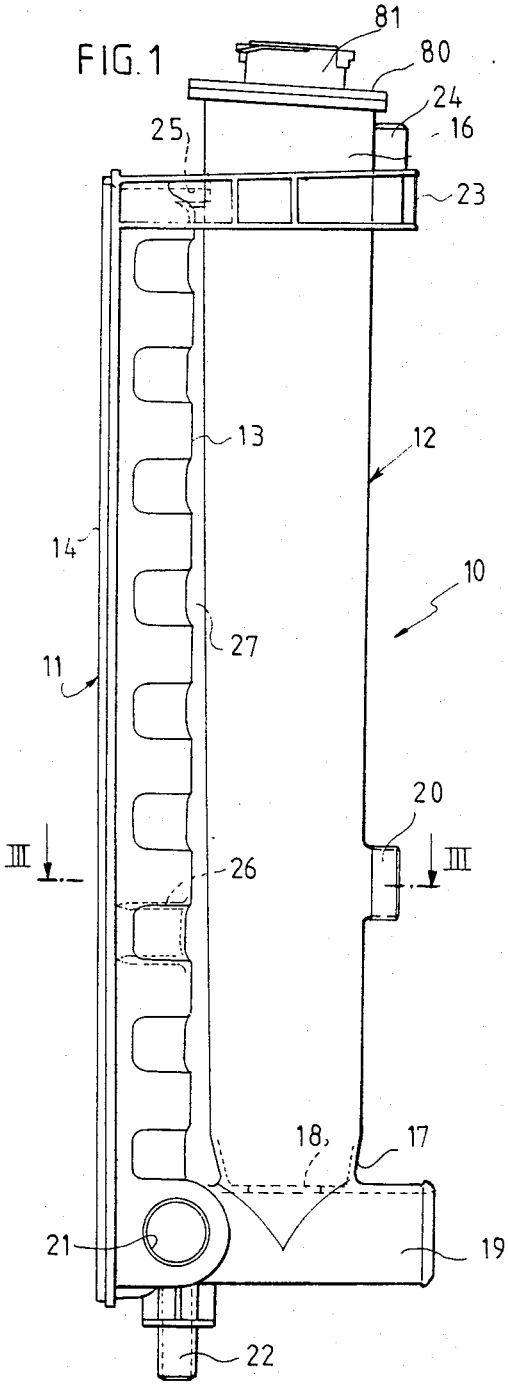
FIG. 1 is a front view of first embodiment of the invention.
Figure 2:
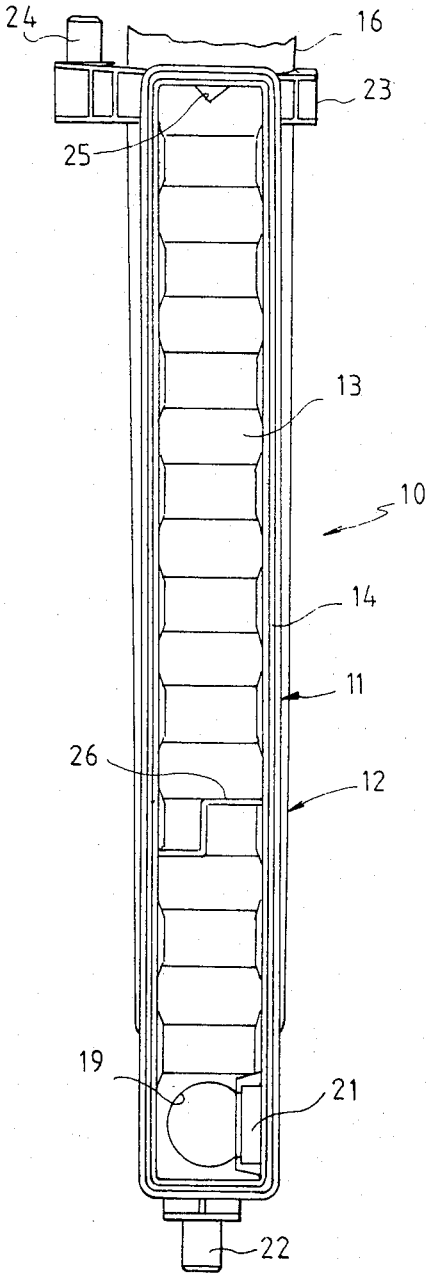
FIG. 2 is a left hand side view of the device shown in FIG. 1.
Figure 3:
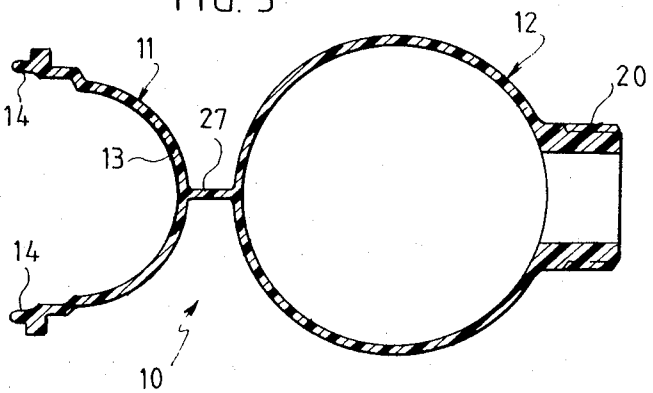
FIG. 3 is a cross section along a line III—III in FIG. 1 and to a larger scale.

Reference is made initially to FIGS. 1 to 3 which show a first embodiment of the invention.

The device 10 shown in these figures comprises a water box 11 and an expansion chamber 12 which are disposed parallel to and close to each other, but not touching each other directly. The device is a single piece moulding of plastics material or the like.

The water box 11 includes a thin, substantially semi-cylindrical wall 13 of semi-circular section, which may include ribs to give it strength to resist being deformed by variations in internal pressure. The edges of the semi-cylindrical wall 13 end in portions 14 for fixing the device to the collector plate or tube plate of a heat exchanger, in a well known manner that need not be described further.

The expansion chamber 12 is likewise a thin-walled container or tank, and is in the form of a slightly tapering cylinder of circular section, where the tapering shape is a standard thechnique for easing extraction of a moulding core after the expansion chamber has been moulded. Its upper end 16 could directly form a filler inlet (not shown) suitable for receiving a stopper of the type that includes pressure release valves for both too low and too high pressure. However, in the example shown, the upper end 16, which is also the un-moulding end, is fitted with a filler inlet in the form of an add-on plate 80. The inlet tube 81 is part of the add-on plate 80 and can thus be made in any desired size and pointed in any desired direction without needing to change the mould for the expansion chamber. The said inlet tube 81 is suitable for receiving a stopper, which may likewise be of any desired type, e.g. having pressure release valves. The lower end 17 of the expansion chamber 12 is funnel-shaped, ending in an orifice 18 leading to a substantially horizontal tube 19 which constitutes the outlet tube of the heat exchanger as a whole and is connected to the water-box 11.

In the example shown, the expansion chamber 12 includes an intermediate access tube 20 for mounting a fluid level detector, while the bottom end of the water box 11 includes an access tube or orifice 21 for mounting a temperature detector, and a peg 22 for fixing on a suitable support.

At their upper ends, the expansion chamber 12 and the water box 11 are held together by a ribbed collar 23 which also has a peg 24 for fixing to said support. A de-gassing duct 25 interconnects the inside volumes of the water box 11 and the expansion chamber 12. The inside volume of the water box is divided into two chambers by a transverse S-shaped partition 26, the device as illustrated being suitable for use with a nest of heat exchanger tubes of the type using S-shaped circulation of liquid.

As can be seen more clearly in FIG. 3, the water box 11 and the expansion chamber 12 are also held together by a flat strip 27 of material derived from moulding the water box 11 and the expansion chamber 12 in a single piece. Said strip extends from the lower outlet tube 19 up to the ribbed collar 23. The strip 27 is not essential, but it improves the performance of the expansion chamber 12 when subjected to vibration.

Figure 4:
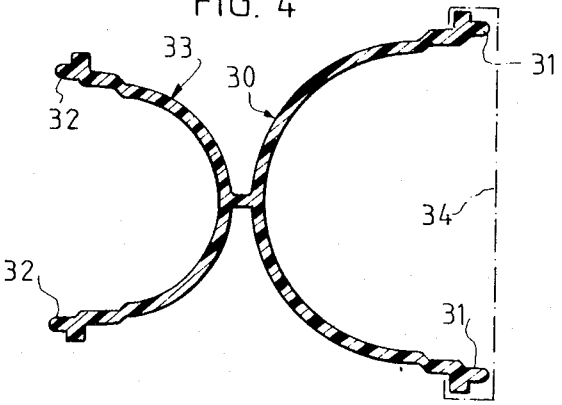
FIG. 4 is a similar view to FIG. 3, but showing a second embodiment of the invention.

Reference is now made to FIG. 4 which shows a second embodiment of the invention. In comparison with FIG. 3, it can be seen that the second embodiment differs from the first device 10 that has just been described, only in the shape of the expansion chamber 30. In the second embodiment, both the expansion chamber 30 and the water box 33 are substantially semi-cylindrical, with the expansion chamber 30 having edges 31 that are substantially the same shape as the edges 32 of the water box 33, whereby the expansion chamber 30 can be closed by an add-on plate 34 suggested by a chain dotted line in the figure. This plate 34 is advantageously similar to the collector or tube plate for the nest of heat exchanger tubes that is to be mounted on the water box 33. The add-on plate 34 could alternatively be semi-cylindrical (not shown).

Figure 5:
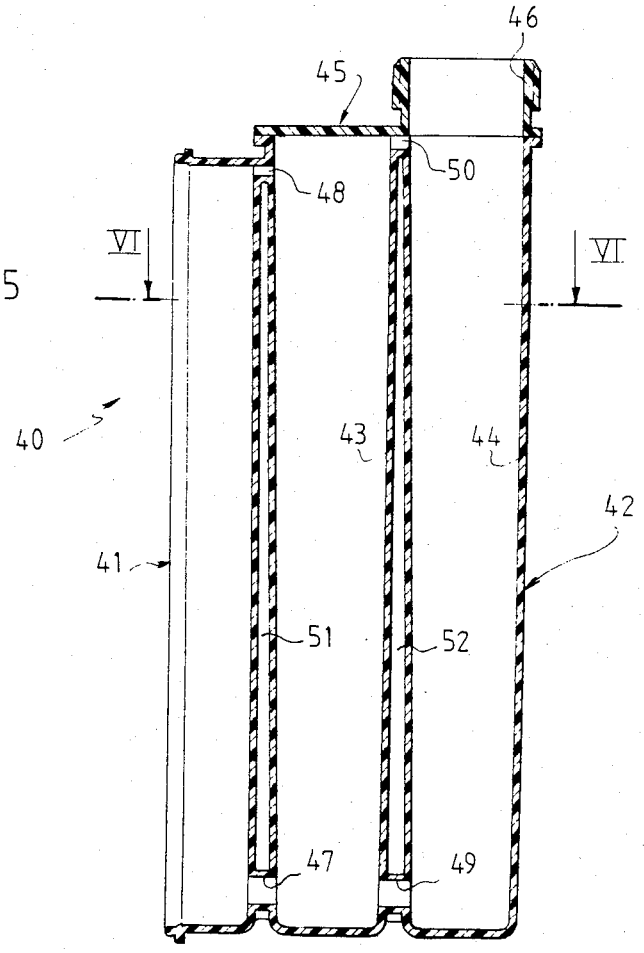
FIG. 5 is a longitudinal section through a third embodiment of the invention.
Figure 6:
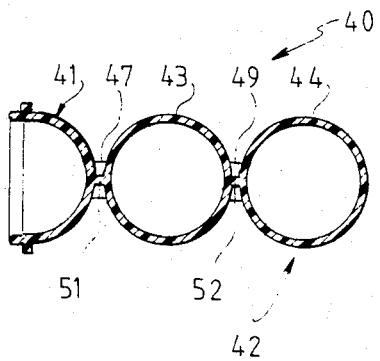
FIG. 6 is a cross section along a line VI—VI of FIG. 5.

Reference is now made to FIGS. 5 and 6 which show a third embodiment of the invention.

In the third embodiment, the water box and expansion chamber sub-assembly 40 comprises a water box 41 that is substantially semi-cylindrical in shape (like those shown in FIGS. 1 to 4), and an expansion chamber 42 that is made up of two compartments 43 and 44 both of which are in the shape of slightly tapering cylinders of circular section, which are disposed in parallel with each other, and which are close to, but separate from, each other.

The compartments 43 and 44 are closed at their lower ends during moulding. At their upper ends which are initially open, they receive a plate 45 which closes top of the compartment 43 and provides a filler tube 46 at the top of the compartment 44. The plate 45 may be made from any suitable material, and fixed to the tops of the compartments 43 and 44 by any appropriate means. It also makes it possible to accommodate a stopper of any desired shape or size, and pointed in any desired direction.

The water box 41 communicates with the first compartment 43 of the expansion chamber 42 at its bottom end by a tube 47 and at its top end by a de-gassing duct 48. The first compartment 43 communicates with the second compartment 44 at its bottom end by a tube 49 which is substantially in line with the tube 47, and at its top end by a de-gassing duct 50. The water box 41 and the compartments 43 and 44 are made in a single piece moulding, with the water box 41 being connected to the first compartment 43 by a thin strip 51 extending between the tube 47 and the duct 48, and the first compartment 43 being similarly connected to the second compartment 44 by a thin strip 52.

It will be understood that this embodiment doubles the volume of the expansion chamber 42 compared with that shown in FIGS. 1 to 3, without requiring more room transversely.

Figure 7:
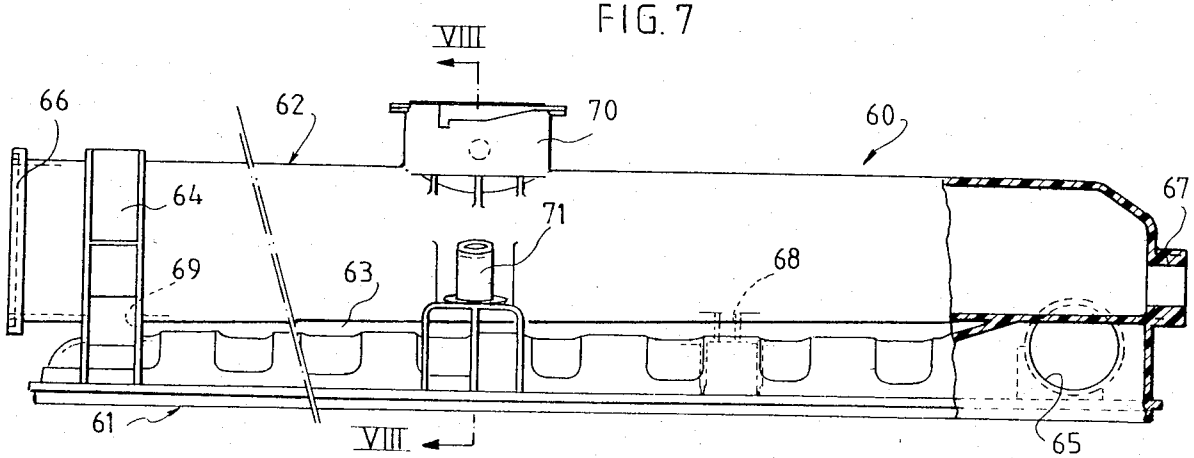
FIG. 7 is a front view of a fourth embodiment of the invention.
Figure 8:
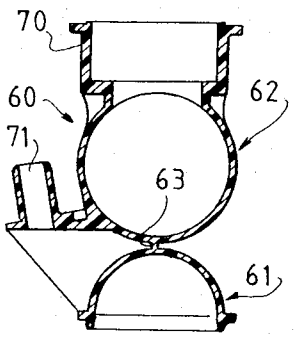
FIG. 8 is a cross section along a line VIII—VIII of FIG. 7.

Reference is now made to FIGS. 7 and 8 which show a fourth embodiment of the invention, in which the expansion chamber and the water box are suitable for being disposed horizonally in use, whereas the embodiments described so far have been for use in a vertical position.

The device 60 shown in FIGS. 7 and 8 comprises a substantially semi-cylindrical water box 61 of the same type as those already described, and an expansion chamber 62 of substantially cricular section. The expansion chamber 62 is held to the water box 61 over most of their length by a thin flat strip 63 of material coming from the two members being moulded in a single piece. They are also connected at one end by a ribbed collar 64, and at the other end by a portion which includes an inlet or outlet tube 65 for liquid flowing through the heat exchanger. The end 66 of the expansion chamber 62 adjacent to the collar 64 is open during manufacture to allow a moulding core to be extracted, and is closed by a plate 66 which may be fitted with a filler opening (not shown). The other end of the expansion chamber 62 includes a fitting 67 suitable for receiving an accessory such as a fluid level guage.

The inside volume of the water box 61 communicates with the inside of the expansion chamber 62 via a de-gassing duct 68 and via a suction tube 69 located level with the ribbed collar 64.

As shown, the expansion chamber 62 also includes a filler opening 70 arranged vertically and located substantially in the middle of the expansion chamber. Clearly only one filler opening need be supplied, either on the plate 66 or on the top of the expansion chamber 62 itself. A tubular peg 71 for engaging a suitable support may also be provided.

Generally speaking, the invention makes it possible to reduce the wall thickness of the water box and the expansion chamber by about 30% for given strength against vibration and internal pressure, or alternatively, for prior art wall thickness, the invention considerably increases said strength.

I claim:

1. In a heat exchanger comprising a water box and an expansion chamber, a sub-assembly comprising at least part of the wall of the water box and at least part of the wall of the expansion chamber, said at least parts of the walls comprising a plastic material being formed in a single piece and being of a cross-section adapted to resist deformation caused by changes in pressure inside the water box and expansion chamber being of substantially circular or semi-circular cross-section, wherein the parts of the walls comprised by said sub-assembly are external to each other such that the water box and expansion chamber substantially do not contain a wall which is liquid-contacting on both sides.

2. A sub-assembly according to claim 1, wherein said single piece is obtained by moulding.

3. A sub-assembly according to claim 1, wherein the water box and the expansion chamber are distant from each other, and are interconnected by a suction tube and/or by a de-gassing duct.

4. A sub-assembly according to claim 2, wherein the water box and the expansion chamber are held together by a thin strip of material obtained by said moulding.

5. A sub-assembly according to claim 2, wherein one end of the expansion chamber constitutes an unmoulding orifice, said orifice being closed by a plate added to the moulding.

6. A sub-assembly according to claim 5, wherein the plate includes a filler opening for the assembled heat exchanger.

7. A sub-assembly according to claim 1, wherein said parts of the water box and expansion chamber walls are semi-cylindrical in shape, the water box wall being closed by a collector or tube plate for the nest of heat exchanger tubes, and the expansion chamber wall being closed by a flat or semi-cylindrical plate.

8. A sub-assembly according to claim 1, wherein the water box is semi-cylindrical in shape and the expansion chamber is cylindrical.

9. A sub-assembly according to claim 1, wherein the expansion chamber includes two compartments, each external to the other and interconnected by tubes or ducts.

10. A sub-assembly according to claim 9, made by moulding, and wherein the two compartments constituting the expansion chamber are held together by a thin strip of material obtained by said moulding.

11. A sub-assembly according to claim 9, wherein the two compartments constituting the expansion chamber are open at an upper end, said end receiving an add-on plate which closes one of said compartments and provides a filler opening for the heat exchanger at the upper end of the other one of said compartments.

12. In a heat exchanger comprising a water box and an expansion chamber, a sub-assembly comprising at least a part of the wall of the expansion chamber and at least a part of the wall of the water box, wherein the parts of the walls comprised by said sub-assembly are external to each other, are distant from each other, and are interconnected by a suction tube and/or by a degassing duct, and wherein said at least a part of the wall of the water box and at least a part of the wall of the expansion chamber comprise a plastic material, are made in a single piece and are of a cross-section adapted to resist deformation caused by changes in pressure inside the water box and expansion chamber, being of substantially circular or semi-circular cross section.

13. In a heat exchanger comprising a water box and an expansion chamber, a sub-assembly comprising at least part of the wall of the expansion chamber and at least a part of the wall of the water box, wherein the parts of the walls comprised by said sub-assembly are external to each other, are distant from each other, and are interconnected by a suction tube and/or by a degassing duct, wherein said at least part of the wall of the water box and at least a part of the wall of the expansion chamber comprise a plastic material, are made in a single piece by molding, and are of a cross-section adapted to resist deformation caused by changes in pressure inside the water box and expansion chamber, being of substantially circular or semi-circular cross section, the water box and expansion chamber being held together by a thin strip of material obtained by said molding.

* * * * *